US006691533B2

(12) United States Patent
Feuer

(10) Patent No.: US 6,691,533 B2
(45) Date of Patent: Feb. 17, 2004

(54) ORNAMENT AND JEWELRY CONSTRUCTION

(75) Inventor: Jeffrey Feuer, East Meadow, NY (US)

(73) Assignee: Feuer Arts Inc., East Meadow, NY (US)

( * ) Notice: Subject to any disclaimer, the term of this patent is extended or adjusted under 35 U.S.C. 154(b) by 0 days.

(21) Appl. No.: 10/197,118

(22) Filed: Jul. 17, 2002

(65) Prior Publication Data

US 2003/0014996 A1 Jan. 23, 2003

Related U.S. Application Data

(60) Provisional application No. 60/306,114, filed on Jul. 17, 2001.

(51) Int. Cl.[7] ..... A44C 17/02
(52) U.S. Cl. ..... 63/26; 63/28; 63/29.1
(58) Field of Search ..... 63/1.16, 26, 28, 63/29.1; 434/200, 407; 446/1

(56) References Cited

U.S. PATENT DOCUMENTS 1,529,831 A * 3/1925 Brennan ..... 40/583
2,176,727 A * 10/1939 Simmons ..... 40/618
2,178,055 A * 10/1939 Stupell ..... 40/618
2,253,343 A * 8/1941 Nalick ..... 63/29.1
3,483,716 A * 12/1969 Stenzler ..... 63/15
3,529,373 A * 9/1970 Aaskov ..... 40/618
3,626,718 A * 12/1971 Schneider ..... 63/29.1
3,673,795 A * 7/1972 Nielson ..... 59/80
4,430,869 A * 2/1984 Zinni ..... 63/23
4,827,575 A * 5/1989 Delaney ..... 63/3
5,324,224 A * 6/1994 Anderson et al. ..... 446/61
6,532,766 B1 * 3/2003 Chia et al. ..... 63/26

* cited by examiner

*Primary Examiner*—Andrea Chop
(74) *Attorney, Agent, or Firm*—Schweitzer Cornman Gross & Bondell LLP

(57) ABSTRACT

An ornament/jewelry construction comprises a peripheral frame, a panel bounded by the frame, and a plurality of spaced projections extending upwardly from the panel in a chosen pattern. The frame and panel may be formed integrally or as separate elements. The spaced projections may be formed integrally with the panel or may be insertable, either individually or in groups, into apertures in the panel. individual frame and panel units may be interconnected to form a wide variety or ornamental and jewelry units. The spaced projections may describe a wide variety of patterns and designs, including numbers, letters and other shapes.

19 Claims, 4 Drawing Sheets

FIG.4
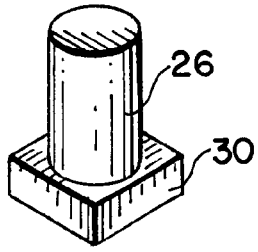
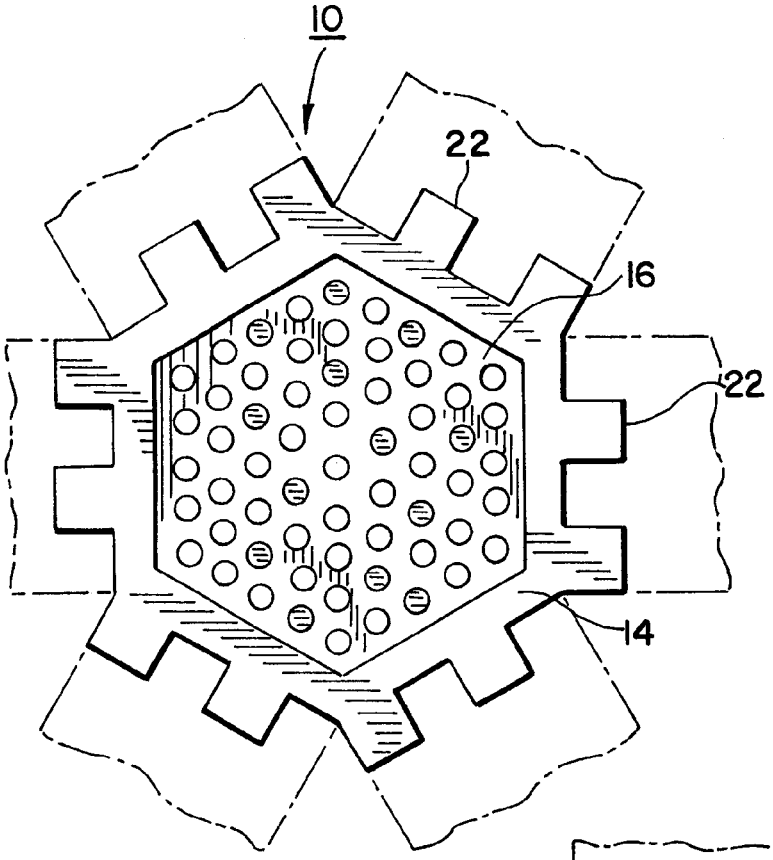
FIG.5
FIG.6
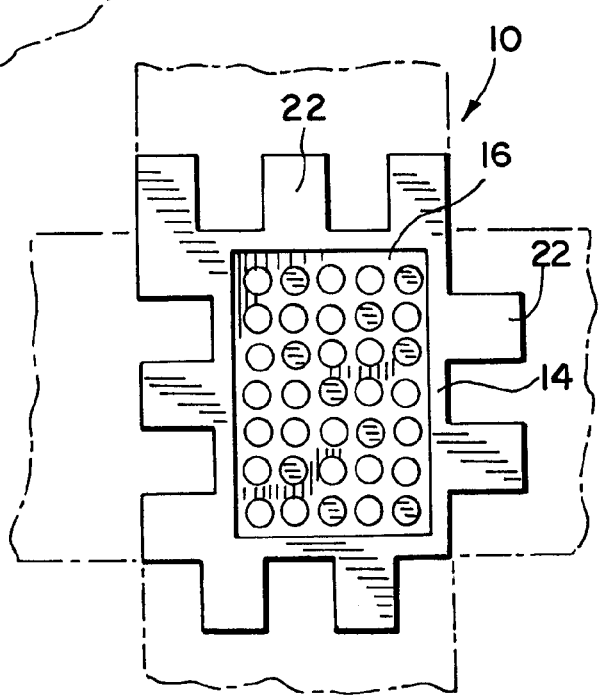

ORNAMENT AND JEWELRY CONSTRUCTION

This application claims the benefit of Provisional application No. 60/306,114 filed Jul. 17, 2001.

The present invention relates to a new and improved construction of particular utility in jewelry and other objects sought to be ornamented, as by personalization and the like.

BACKGROUND OF THE INVENTION

The wearer of a piece of jewelry, or other ornamented items, such as a belt, often desires that the item be somehow unique, or personalized to the wearer. This is conventionally accomplished by an artisan creating a unique design in accordance with the wearer's desires. It is accordingly a purpose of the present invention to provide an ornamentation construction which is both attractive and eye-catching, and which has the capability of being customized in accordance with the wants or desires of a wearer.

It is further a purpose of the present invention to provide an ornamentation for incorporation into jewelry items, as well as other decorative items, and which can be utilized in a variety of styles, such as in bracelets, necklaces, and the like.

Yet a further purpose of the present invention is to provide an ornament and jewelry-type construction which can be changed and modified to provide different appearance aspects.

BRIEF DESCRIPTION OF THE INVENTION

In accordance with the foregoing and other objects and purposes, the ornament and jewelry construction of the present invention comprises a peripheral frame which surrounds an interior panel. A plurality of spaced projections extend upwardly from the frame forming a design, which may be a letter, number or other pattern. The panel may be provided with a plurality of apertures, arranged in a matrix, into which projection elements bearing the projections may be placed. The projection elements themselves may have one or more individual projections extending upward from a common base.

The frame and panel may be formed as an integral unit, or the frame may be insertable into the frame. An individual frame and panel construction may serve as an ornamental or jewelry item, such as a bracelet, pin or pendant. Alternatively, frame and panel units can be interconnected to form a bracelet, belt, or other extended ornamental construction, as well as signage or as an identification unit. The projection elements may be of varying or the same height and may have decorative material applied to their distal, projecting ends.

BRIEF DESCRIPTION OF THE DRAWINGS

A fuller understanding of the present invention will be achieved upon consideration of the following detailed description of preferred, but nonetheless illustrative embodiments thereof, when reviewed in conjunction with the annexed drawings wherein:

FIG. 4 is a perspective view of a projection element used in connection with the invention;

FIG. 5 is a plan view of an alternative construction for a construction utilizing a plurality of frame and panel elements depicting how a plurality of the elements constructions may be joined thereto;

FIG. 6 is a further alternative construction depicting the interconnection of frame and panel elements;

DETAILED DESCRIPTION OF THE INVENTION

Figure 1:
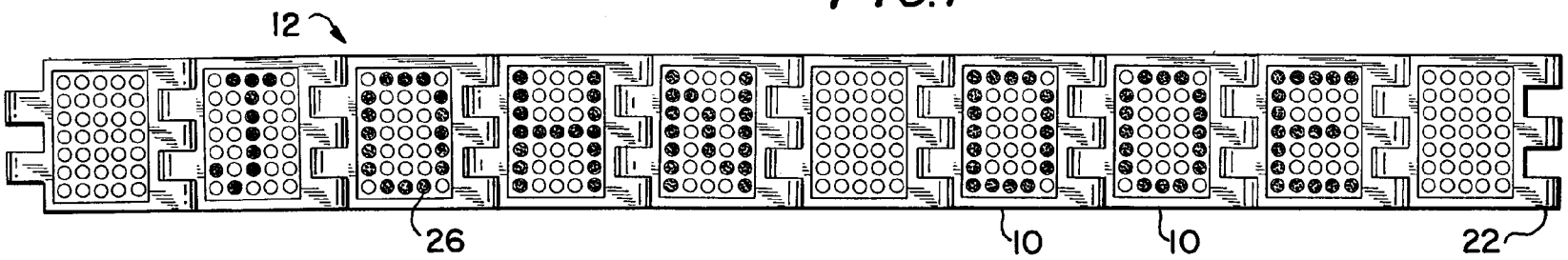
FIG. 1 is a plan view of a bracelet construction in accordance with the invention.
Figure 3:
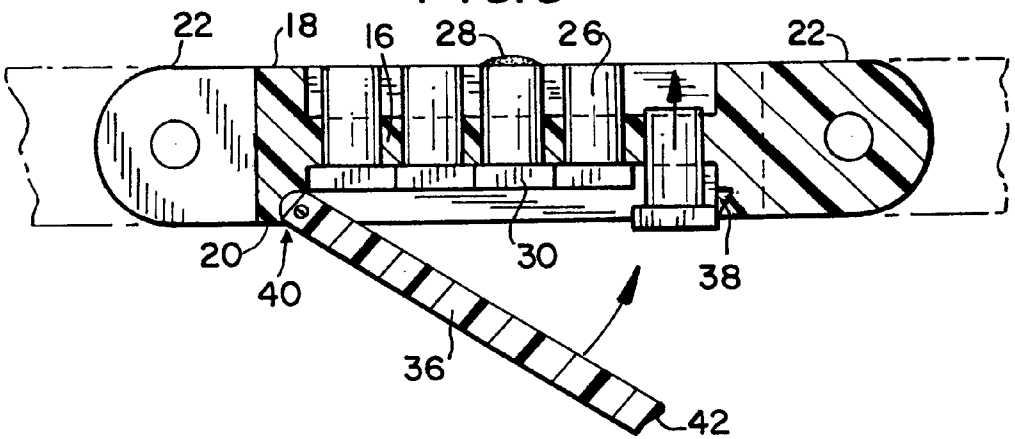
FIG. 3 is a section view taken along line 3—3 of FIG. 2.
Figure 2:
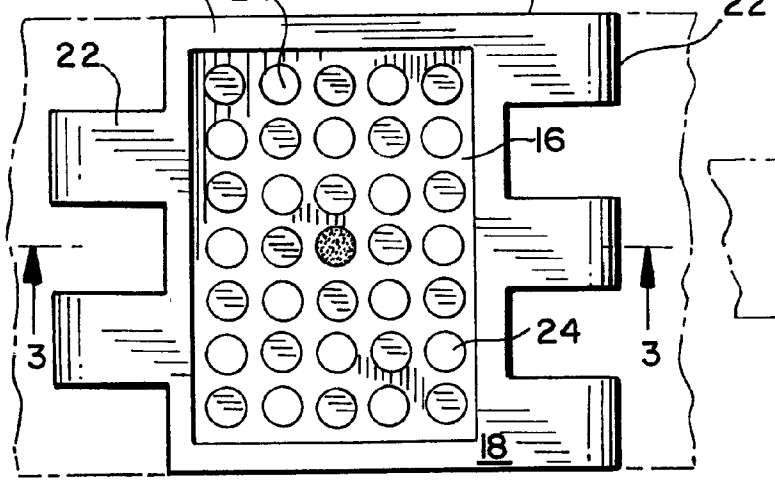
FIG. 2 is an enlarged view of an individual frame and panel element of the type which may be incorporated into the bracelet of FIG. 1.

Referring initially to FIGS. 1–3, the ornament/jewelry construction of the present invention comprises a constructional frame and panel unit 10 which constructional units may be used individually, such as for a pendant or as a ring fitting, or alternatively, as shown in FIG. 1, interconnected with other constructional units to form a composite ornament/jewelry construction, such as the belt or bracelet-like construction of FIG. 1. It is to be noted that in FIG. 1 the distal ends of the depicted construction 12 are shown open. One skilled in the art will readily recognize that the ends can be connected together, or formed with an appropriate clasp mechanism, to form a closed bracelet, belt or necklace-type unit.

Figure 9:
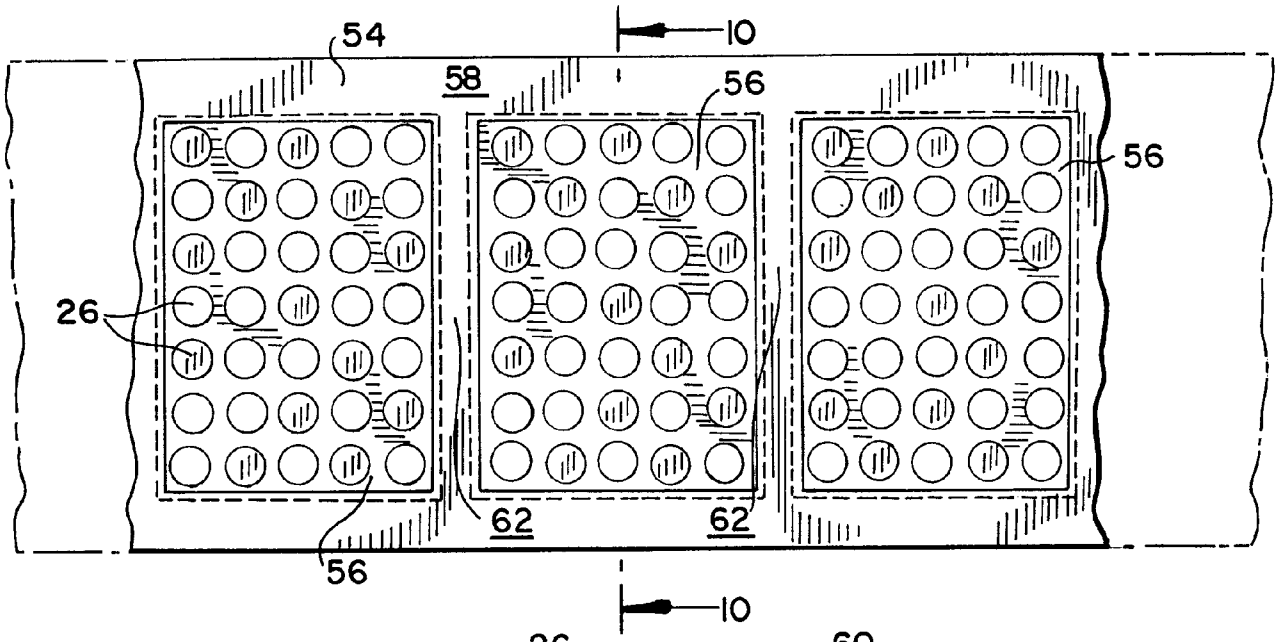
FIG. 9 is an alternative representation of the type of construction of FIG. 7 wherein the panels are constructed as independent elements mounted within the frame.
Figure 10:
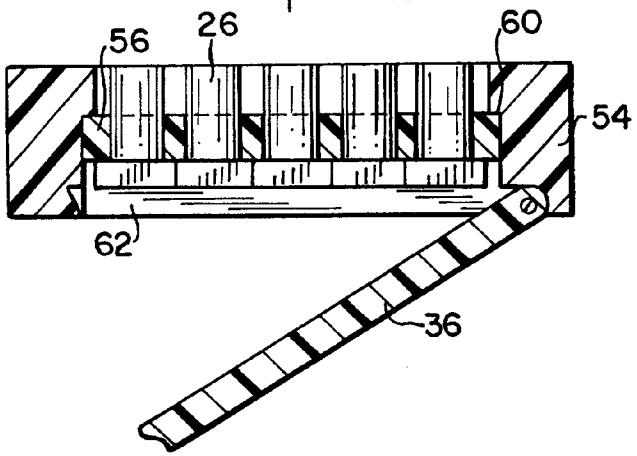
FIG. 10 is a section view taken along line 10—10 of FIG. 9.

As depicted in FIGS. 1–3, a constructional unit 10 comprises a peripheral frame 14 which creates a border which encircles an inner panel 16. The frame and panel may be formed as an integral unit, such as by molding, from a variety of materials, including plastics, metal, rubber, leather and the like. Urethane is a presently preferred material. The panel may be recessed or inset from both the top surface 18 and lower surface 20 of the frame, or may be located flush to the top or bottom. Alternatively, as depicted in FIGS. 9 and 10, the frame may be formed with an interior opening within which the panel, constructed as a separate element, is supported in a desired orientation. The frame 14 may include integral hinge knuckles 22 constructed as known in the art to allow the interconnection of constructional units 10 as depicted in FIG. 1. A hinge pin (not shown) may be inserted through the hinge knuckle of adjoining constructional units to permit the individual constructional units to pivot with respect to each other, allowing a closed loop or other sinuous shapes to be developed.

The panel 16 may be provided with a plurality of apertures 24 extending between its upper and lower surfaces. The apertures may be arranged in a regular, matrix-like pattern as shown in the figures, or may be located and arranged randomly or in other, specific designs or patterns. Each of the apertures 24 is dimensioned to accept the projection element 26. The projection elements 26 are inserted into selected ones of the apertures 24 in accordance with desired design criteria, and the shafts extend upwardly from the panel 16 to create a design. As depicted in FIG. 1, for example, the projection elements are mounted in the individual panels 16 of the overall bracelet construction 12 in a manner which creates the letters to spell out "JOHN DOE". The top surface of a projection element 26 may bear a colorant or reflective coating 28 to enhance its visibility and/or attractiveness. Alternatively, the entire projection element may be colored or coated as desired to provide an appropriate visual effect. It is to be recognized that the design generated by the projection elements 26 may result both from different visual effects of the individual projection elements themselves, as well as a result of the projection elements being inserted into the selected apertures 20. Thus, a wide variety of visual effects can be created by the choice of projection elements and their specific arrangement in the apertures of a constructional unit 10. Indeed, desired design effects may be created also by the lack of projection elements at desired locations, creating a shadow-like appearance.

Figure 11:
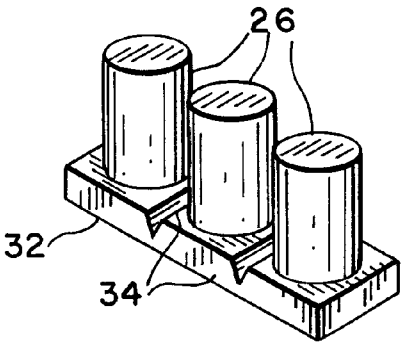
FIG. 11 is a perspective view of a projection element having a plurality of projections extending from a common base.

FIG. 4 depicts an individual projection element 26. It may be formed integrally with the panel 16, along with other projection elements, in a desired pattern, or preferably be constructed to be insertable into an aperture as depicted in FIG. 3. In the insertable form, it may be provided with a base 30 which, when the projection element is installed in an aperture of a panel element, abuts the bottom surface of the panel and prevents the projection element from being removed from the top of the construction. Alternatively, and as illustrated in FIG. 11, a plurality of individual projection elements 26 may be formed with a single integral base portion 32. The base may be provided with notches 34 to allow the individual projection elements to be separated and utilized individually or in smaller combinations. While the projection element shown is circular in cross-section, other cross sections, such as ovals, squares, triangles, stars, etc. may be used. The aperture 24 may similarly be varied to accept the different shapes, or may be of a single, preferably circular shape dimensioned to functionally accept a variety of projection element cross-sections.

As depicted in FIG. 3, the projection elements 26 may be dimensioned so as to have their top surfaces lying in the plane of the top surface 18 of the peripheral frame 14. Alternatively, however, the projection elements may be of varying heights, such that they either extend above the height of the frame or lie below it, as depicted in FIG. 8, at varying heights, including flush with the top surface of the panel, to create particular visual effects, as desired.

The projection elements 26, when inserted into the panel 16, are preferably dimensioned to be frictionally retained therein. Particularly when the panel is created of a resilient material, such as urethane, the projection elements can be constructed of a wide variety of materials, including metal and plastic, and can be held in place by the resiliency of the panel. To further ensure that the projection elements are not inadvertently or accidentally dislodged, however, a rear closure may be employed. As seen in FIG. 3, for example, the rear closure may comprise a door-like panel 36 which is pivotally mounted at 40 to the peripheral frame 14 and is positioned to close off the recessed area behind and below the inserted projection elements 26. The inner sidewall 34 of the panel 16 opposite the pivot 40 may be beveled to accommodate a corresponding-shaped edge 42 of the door to provide a locking function.

Figure 7:
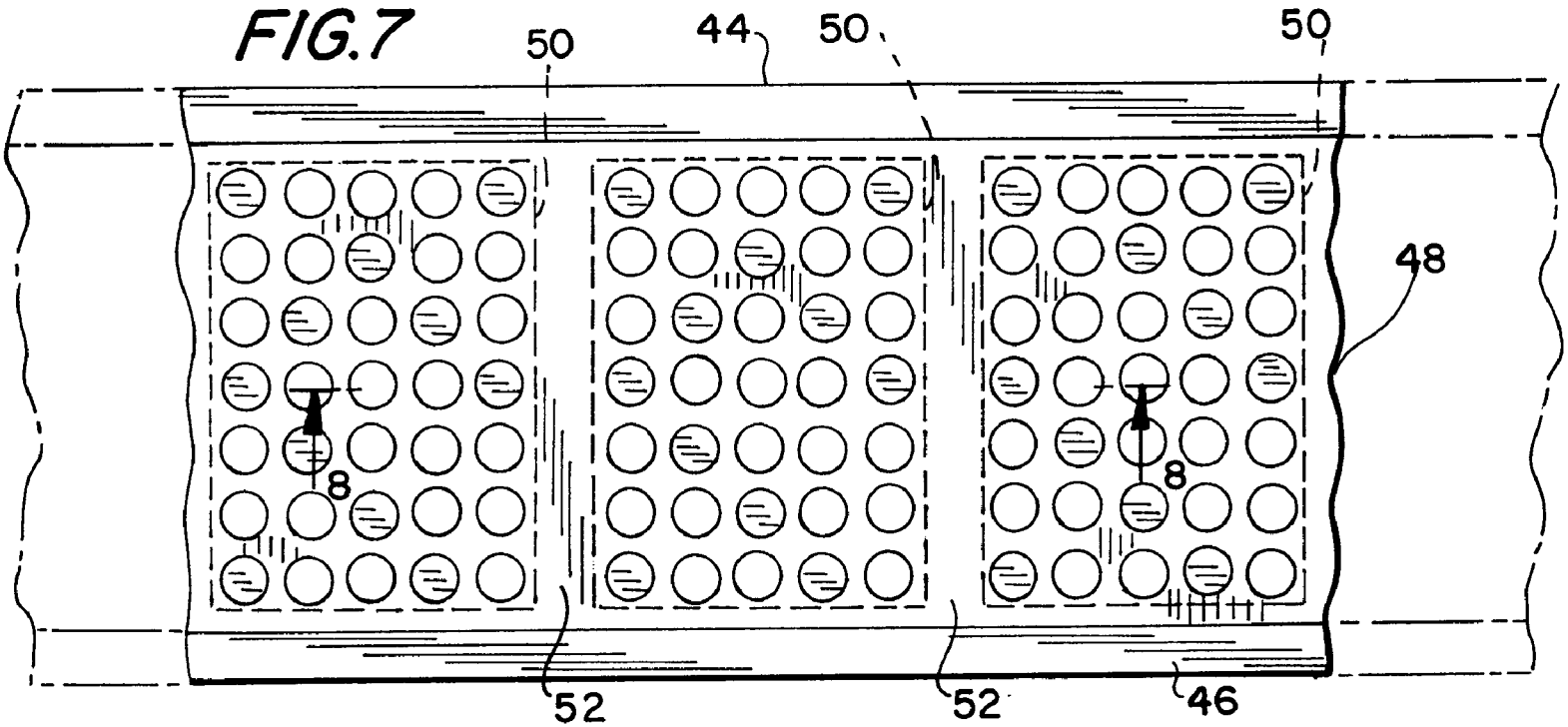
FIG. 7 is a detail plan view of a further alternate embodiment of the invention in which a plurality of panels are supported by a single peripheral frame unit in a unitary construction.

As depicted in FIGS. 5, 6 and 7, a peripheral frame 14 may take any of a variety of shapes. In addition to the generally rectangular construction with two opposed hinge knuckles 22 as depicted in FIG. 2, other frame constructions can be utilized, such as the hexagonal design as depicted in FIG. 5. The means for interconnecting adjacent constructional units, such as the hinge knuckles 18, may be applied to any number of the edges, such as all edges, as shown. Inclusion of such interconnection means along the entire periphery of a constructional unit 10 can allow large overall constructions to be realized. FIG. 6 depicts a rectangular frame 14 having the hinge knuckles on all four sides.

Figure 8:
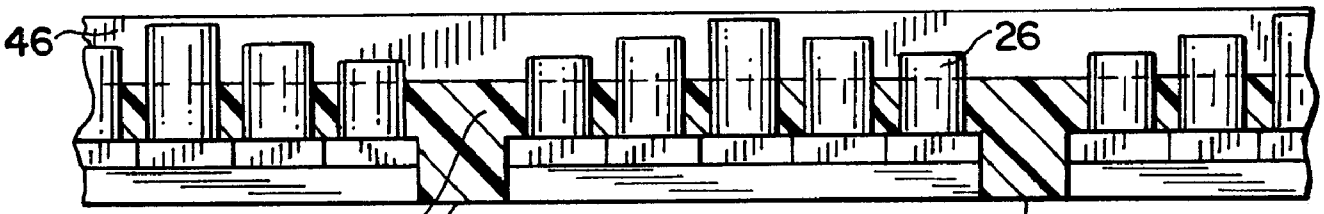
FIG. 8 is a partial sectional view taken along line 8—8 of FIG. 7.

FIGS. 7 and 8 depict a construction in which a constructional unit 44 comprises an elongated peripheral frame 46 and a correspondingly elongated panel 48 formed integrally with the frame. The panel 46 is again positioned within the frame 46, recessed from the frame's top and bottom surfaces. Rather than bearing a continuous matrix of apertures 24 thereon, however, the panel 48 is divided into a plurality of separated aperture bearing sections 50 which mimic the layout of the construction of FIG. 1 in which individual constructional units 10 are assembled in a linear or side-by-side manner. To create the appearance of separate constructional units, the frame 48 is provided with a series of intermediate border portions 52, which serve to divide the panel into a series of portions 50. The border portions extend downwardly, as seen in FIG. 8, their bottom surfaces being flush with the bottom peripheral surface of the frame. Thus, while the constructional unit 44 is of an integral construction, it provides a construction which replicates the existence of individual panel elements. The projection elements 26 are again inserted into the apertures in a desired pattern. The present construction also depicts a structure which does not utilize door panels, the projection elements 26 being retained in the apertures solely by frictional engagement therebetween.

FIGS. 9 and 10 depict yet a further alternative construction, similar to that of FIGS. 7 and 8, in which an elongated peripheral frame 54 is provided. In this construction, however, there are a plurality of individual, independent panels 56 which are each frictionally retained by a portion of surrounding peripheral wall 58 of the peripheral frame 54 and interior border 62. As shown, the peripheral wall and border of the frame is provided with an internal shoulder 60 against which the panel 56 rests when inserted from the rear of the construction. The dimensions of the panel 56 are chosen to provide a snug fit whereby it can be retained within the frame. In this construction, a door panel 36 can be utilized to further assist in retaining the panel, with the projection elements 26 mounted therein, within the frame. Other mounting for the panels can be used to position the panel as desired within the frame.

It is to be appreciated by those skilled in the art that the foregoing embodiments are intended to be merely illustrative of the present invention and that other variations and modifications thereto can be accomplished without departing from the true scope of the invention.

I claim:

1. An ornamental jewelry construction, comprising:

a peripheral frame having an upper surface;

at least one panel within the frame, the panel having a matrix of apertures; and at least one projection element having a base and a plurality of projections extending upwardly therefrom, the projection element base being located behind the panel and the projections each being aligned with and extending through an aperture of the matrix of the panel from a rear of the panel to delineate a pattern against the panel when viewed from the front of the panel.

2. The construction of claim 1 wherein the panel is located below the plane of the upper surface of the frame.

3. The construction of claim 1 wherein the projections each have a top surface located at or below the plane of the upper surface of the frame.

4. The construction of claim 3 wherein the top surfaces of the projections are all at the same level.

5. The jewelry construction of claim 1 wherein the frame and the panel are of a unitary construction.

6. The construction of claim 1 wherein the apertures are dimensioned to frictionally support the projections extending therethrough.

7. The construction of claim 6 wherein the panel is constructed of urethane.

8. The construction of claim 1 further comprising means for interconnecting at least two peripheral frames together.

9. The construction of claim 8 wherein the interconnecting means comprise a hinge.

10. The construction of claim 9 wherein the hinge is formed integral with the peripheral frame.

11. The construction of claim 10 further comprising a plate located behind the panel to assist in retaining the projection elements in the apertures.

12. The construction of claim 11 wherein the plate is a door pivotally mounted to the frame.

13. An ornamental jewelry construction, comprising:

an elongated peripheral frame having a plurality of individual panels, each of the panels having a matrix of apertures extending between front and rear surfaces thereof; and a projection element having a base and a matrix of projections extending upwardly therefrom located behind the rear surface of at least one of the panels, the projections aligned with, and insertable through, corresponding ones of the apertures from the rear surface and projecting therethrough towards the front surface, the projections bearing surface ornamentation to form a chosen pattern observable against the surrounding panel from the front surface side of the panel when the matrix of projections are inserted through the apertures.

14. The construction of claim 13 wherein the projections extend beyond the panel front surface when the matrix of projections are inserted through the apertures.

15. The construction of claim 14 wherein the projection element includes integral means for retaining the projection element in a position with the projections extending through the apertures.

16. The construction of claim 15 wherein the projection element projections are capable of being frictionally retained by the apertures of the panel through which they extend.

17. The construction of claim 13 wherein the panel is constructed of urethane.

18. The construction of claim 13 further comprising a plate located behind the panel to assist in retaining the projection elements in the apertures.

19. An ornamental jewelry construction kit, comprising:

an elongated peripheral frame forming a surrounding border for a plurality of individual panels, each of the panels having a matrix of apertures extending between front and rear surfaces thereof; and a plurality of projection elements, each having a base and a matrix of projections extending upwardly therefrom, each projection element being dimensioned to be retained by one of said panels and surrounded by the frame with the projections being located and dimensioned to extend through corresponding ones of the apertures in the one of said panels, the projections bearing surface ornamentation to form an observable pattern projecting through the frame, whereby upon retaining of a plurality of projection elements by corresponding panels a design extending along a length of the frame is created.

* * * * *